United States Patent [19]

Bouchette et al.

[11] Patent Number: 4,612,231

[45] Date of Patent: Sep. 16, 1986

[54] PATTERNED DRY LAID FIBROUS WEB PRODUCTS OF ENHANCED ABSORBENCY

[75] Inventors: Michael P. Bouchette; Johannes A. Van den Akker, both of Appleton, Wis.; William R. Watt, Princeton Junction, N.J.

[73] Assignee: James River-Dixie Northern, Inc., Norwalk, Conn.

[21] Appl. No.: 653,836

[22] Filed: Sep. 24, 1984

Related U.S. Application Data

[62] Division of Ser. No. 309,015, Oct. 5, 1981, abandoned.

[51] Int. Cl.[4] ..... A61F 13/16; B32B 5/12

[52] U.S. Cl. ..... 428/167; 156/209; 156/219; 428/171

[58] Field of Search ..... 428/167, 171; 156/209, 156/219

[56] References Cited

U.S. PATENT DOCUMENTS

| | | | |
|---|---|---|---|
| 3,005,364 | 10/1961 | Broderick . | |
| 3,017,304 | 1/1962 | Burgeni . | |
| 3,337,338 | 8/1967 | Krock . | |
| 3,414,459 | 12/1968 | Wells . | |
| 3,616,157 | 10/1971 | Smith . | |
| 3,647,618 | 3/1972 | Back et al. . | |
| 3,692,622 | 9/1972 | Dunning . | |
| 3,776,807 | 12/1973 | Dunning . | |
| 3,806,406 | 4/1974 | Ely . | |
| 3,867,225 | 2/1975 | Nystram . | |
| 3,903,342 | 9/1975 | Roberts . | |
| 3,905,863 | 9/1975 | Ayers . | |
| 3,974,025 | 8/1976 | Ayers . | |
| 4,103,058 | 7/1978 | Humlicek . | |
| 4,125,659 | 11/1978 | Klowak et al. . | |
| 4,127,637 | 11/1978 | Pietreniak | 428/171 |
| 4,134,948 | 1/1979 | Baker . | |
| 4,135,024 | 1/1979 | Callahan . | |
| 4,145,664 | 3/1979 | McConnell et al. . | |
| 4,191,609 | 3/1980 | Trokhan . | |
| 4,192,713 | 3/1980 | Valkama . | |
| 4,207,367 | 1/1980 | Baker . | |
| 4,211,227 | 7/1980 | Anderson . | |
| 4,443,512 | 4/1984 | Delvaux | 428/171 |

FOREIGN PATENT DOCUMENTS 1372502 10/1974 United Kingdom .

*Primary Examiner*—Marion C. McCamish
*Attorney, Agent, or Firm*—Finnegan, Henderson, Farabow, Garrett & Dunner

[57] ABSTRACT

A method of improving absorbency of air laid bonded fibrous webs and the products resulting therefrom, the preferred method comprising the step of imprinting at least one surface of the fibrous web between a pair of cylindrical rolls under a pressure of at least 100 pounds/lineal inch, the compacted area of each imprinted web surface being at least 40%, preferably at least 50%, of the total imprinted surface. In the preferred embodiment of the method, the fibrous web is first wetted with water, the imprinting step then being conducted with imprinting means heated to about 140° to about 180° C.

The products obtained have densified zones underlying the compacted areas, the density thereof being at least 0.1 gm./cc., which zones enhance absorbency as compared to unimprinted webs by at least 25%. The preferred webs provided by the method are imprinted with a grid-like pattern, said pattern preventing nesting of individual sheets in product rolls and containers.

11 Claims, 6 Drawing Figures

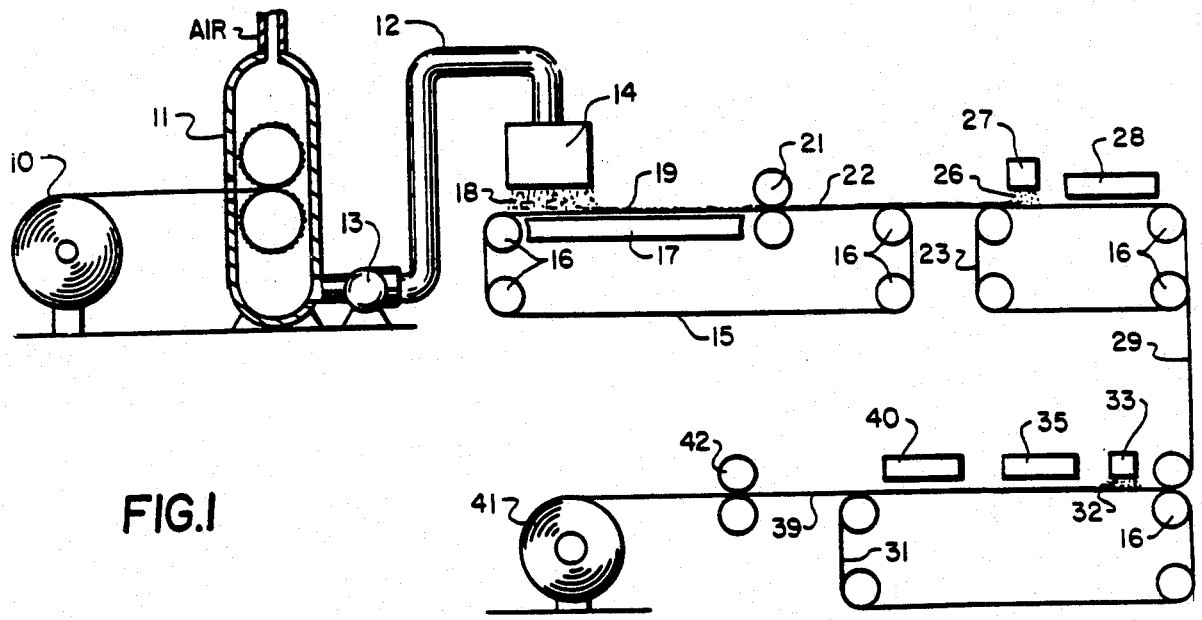
FIG.1
FIG. 2
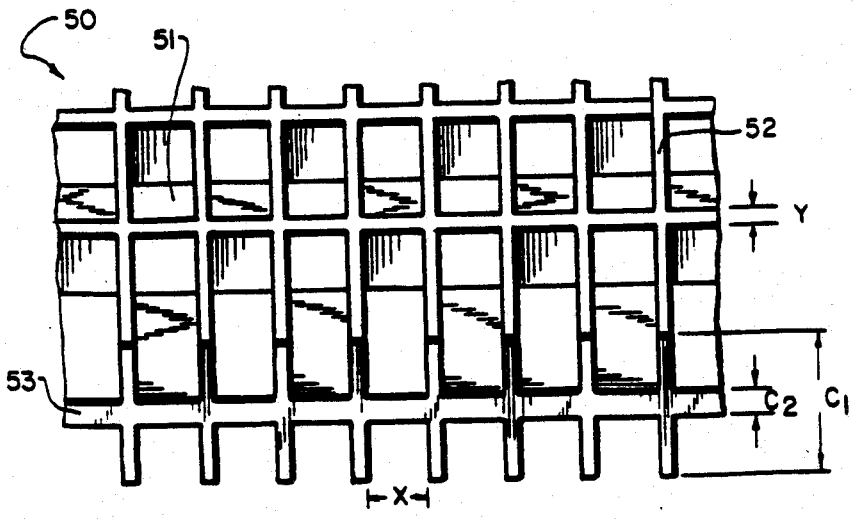

DRYFORMED PAPER BEFORE PRESSING

DRYFORMED PAPER PRESSED @ 16 PSI

PATTERNED DRY LAID FIBROUS WEB PRODUCTS OF ENHANCED ABSORBENCY

This is a division of application Ser. No. 309,015, filed Oct. 5, 1981, now abandoned.

FIELD OF INVENTION

The present invention relates to air laid (or dry laid) fibrous webs a portion of at least one surface being compacted by application of an imprinted pattern or design which pattern enhances the rate of absorption during use as well as improving the retention of liquid absorbed within the webs. More specifically, the invention relates to air laid cellulosic webs whose individual fibers are bonded together by an adhesive material essentially permeating said web, the bonded web having said pattern on at least one surface thereof, the compacted area thereof comprising at least about 40% of the total area per imprinted surface. Imprinting of the web surface(s) to this degree densifies those interior portions of the web underlying each compacted area thereby promoting capillary tension and wicking to enhance web absorbency and wiping characteristics. Most specifically, the invention relates to tissue, towel and napkin products of high bulk and rapid absorbency obtained from bonded air laid cellulosic fibrous webs, in accordance with the method disclosed here. Preferably, a non-nesting pattern is imprinted on the web to prevent loss of final product size, e.g., product roll diameter.

BACKGROUND OF INVENTION

Fibrous webs, particularly low basis weight webs between 8 and 60 lbs. per ream (3,000 sq. ft.), for use ultimately as tissue, towel and napkin products, are fabricated conventionally by two alternate processes. The older wet laid process dispenses an aqueous slurry of pulped paper-making fibers, generally natural cellulose fibers, onto a moving foraminous support means, e.g., a fourdrinier wire, the aqueous medium being removed through the support means by vacuum means. The wet laid web is thermally dried and taken up on a parent roll. Because of the presence of water, the wet laid web fibers bond naturally to one another by means of hydrogen bonding. Such conventionally prepared webs are sometimes creped to improve feel and enhance absorbency. Similarly, the webs may be embossed to enhance softness and to provide a more aesthetic appearance.

The second, now conventional, yet relatively recent, process defiberizes cellulose pulp, the dry individual fibers being pneumatically transported to the dispensing means, and then dry laid (or air laid) onto the moving foraminous support means. Vacuum means below the support means is employed to ensure that the dry fibers remain on the web, which web has little inherent strength inasmuch as hydrogen bonds are not formed substantially in the absence of an aqueous medium. The dry, initially laid web is then sprayed with a synthetic bonding agent, such as a latex emulsion, preferably on both surfaces of the web. The bonding agent is cured by passing the thus treated web though a dryer, e.g., a through air dryer, before being taken up on a parent roll. These webs may also be creped and embossed.

Generally speaking, wet laid webs provide better wiping absorbency than dry laid webs. That is, under dynamic conditions of use, wet laid webs absorb liquid at a faster rate and retain the liquid thus absorbed better than their dry laid counterpart. The slower rate of wiping absorbency associated with dry laid webs is primarily due to the greater volume of interstitial voids existing within the reticulated structure of these webs. The greater void volume is occasioned by the larger size, on average, of individual pores, as well as by the greater degree of reticulation extant in the overall web structure. These interstitial voids provide a greater interstitial liquid holding capacity under static conditions, but permit absorbed liquid to be squeezed back out more easily under dynamic wiping conditions. The net result is an appeared slower rate of wiping absorbency for dry laid webs. The advantages of greater void volume or bulk present in dry laid webs are several. Less fiber per ream is required to fabricate the web. The greater void size provides greater static liquid holding capacity, and typically contributes to a softer feeling web. Finally, dry laid webs have greater wet strength than conventional wet laid webs, and, hence, do not break apart as readily during use. Thus, substantial improvement in wiping or dynamic absorbency characteristics would greatly improve product acceptance and usefulness.

Applicants have found that a pattern imprinted on at least one surface of a dry laid web wherein the compressed areas comprise at least 40% of the total imprinted area improves web absorption rate and enhances water retention during use. Heretofore, patterned webs, whether by imprinting or by embossing, have been produced to enhance the softness, improve the bulk, or to alter the strength and stretch characteristics of the web, as well as to impart an aesthetic design to the surface.

Embossing and imprinting as used in this application are distinguished below, although terminology in the art is not uniform and does overlap.

In conventional embossing, a raised pattern is formed on a portion of a first web surface (the raised portion), with corresponding depressions in the remaining portion of said web surface (the depressed portion). These discontinuities in the first surface of the web are occasioned by passing the web between two cylindrical rolls, one of which is resilient, the other being inextensible and having a plurality of bosses thereon. The bosses contact the second surface of the web forming the raised areas (and depressions) on the first surface in contact with the resilient roll. Typically, the raises comprise about 20 to 30% of the total first surface area, the depressions accounting for the remaining area. Surface depressions are also formed on the second surface where the bosses come into contact with the web, these depressions being in alignment with the raises on the first surface. Embossing of this nature may result in products having a raised area approaching 60%, as in U.S. Pat. No. 3,337,388 to Wosaba, which embossing improves softness, bulkiness and sponginess.

Imprinting, on the other hand, as the term is used herein, compresses certain portions of a web surface in intaglio, the other surface not being raised thereby. Necessarily, imprinting densifies the compressed surface portions substantially more than embossing.

Imprinting, as opposed to embossing, has heretofore been used in wet laid processing in conjunction with subsequent creping as disclosed in, for example, U.S. Pat. No. 4,191,609 to Trokhan and U.S. Pat. No. 4,125,659 to Klowak et al. In so doing the finally creped product exhibits greater softness, improved stretch and tensile strength, and enhanced bulk.

In dry formed webs surface imprinting, as hereinbefore defined, has been performed to improve the application of bonding agent to the web. In U.S. Pat. No. 4,127,637 to Pietreniak et al between about 15 to 40% of the web surface is compressed by cylindrical rolls prior to bonding, the pattern being then stabilized with binder to retain the differential density. The web is then creped to improve softness and bulk. Similarly, U.S. Pat. No. 4,135,024 to Callahan et al imprints one web surface, simultaneously applying binder to the other web surface, thereby enhancing permeation of the binder into said web. U.S. Pat. Nos. 3,692,622 and 3,776,807 to Dunning and Dunning et al respectively disclose spot bonding of dry laid webs wherein 5 to 40% of the web surface is imprinted. In Baker, Jr., U.S. Pat. Nos. 4,207,367 and 4,138,848, a plurality of highly compressed, narrow regions, preferably about 30% of the surface, separate the high loft regions, the high loft regions being bonded only partially.

Finally, embossing and imprinting are employed to laminate two webs together as disclosed in U.S. Pat. No. 3,867,225 to Nystrand.

SUMMARY OF THE INVENTION

It is an object of the present invention to provide an air laid fibrous web product having enhanced wiping absorbency rate characteristics.

It is another object of the invention to provide a bulky, absorbent cellulosic web product having a high degree of perceived softness.

It is a further object of the invention to provide a dry laid fibrous web product at least one surface of which has been imprinted with a design, the compacted area of each imprinted surface representing at least 40%, preferably 50%, of each surface area. The high degree of compaction enhances the absorbency rate and wiping characteristics of said web without excessive reduction of product size, e.g., web roll diameter.

Another object of the invention is to provide bulky cellulosic web products, for example, tissue, towel and napkin products, having an enhanced rate of absorbency and improved wiping performance, each surface of which has received an imprinted pattern, the compacted area of each imprinted surface representing at least 40%, preferably 50%, of same.

A collateral object of the present invention is to provide a method for the manufacture of the absorbent webs and web products of the present invention.

These and other advantages and objects of the invention will be readily perceived upon inspection of the drawings, and upon a reading of the detailed description of the invention, a summary of which follows.

To obtain the soft, bulky products of the invention which have improved wiping absorbency properties, an air laid bonded web is imprinted with a depressed design, preferably with a non-nesting pattern to avoid loss of final product roll diameter. In one embodiment of the method, the bonded web to be imprinted is wetted optionally with a spray of water and subjected to an areal pressure of at least about 16 lbs./in.$^2$ by platen means, said means having been heated to a temperature of between about 140° to about 180° C. To improve wiping absorbency at least one surface of the treated web must have a compacted area of at least about 40% of the total imprinted surface area, preferably between 50% to 80% of the total imprinted surface area. Each side of the web may be so imprinted.

In the preferred embodiment of the method, the imprinting means is a pair of non-resilient cylindrical rolls adapted for imprinting the web continuously. While the levels of compaction are analogous, the applied pressure is at least 100 lbs. per lineal inch. Again, the imprinting means are heated to 140° to 180° C., and a water spray is optional.

The diameter of individual product rolls or the composite thickness of packaged product sheets of the present invention are preferably reduced not more than 10% as compared to unimprinted products. Depending on the pressure applied by the imprinting means, said reduction may approach between 20 and 30%. However, the wiping absorbency of products of the present invention is increased by at least about 25%, preferably about 40% or more, as ascertained by relative values of mirror wipe time between imprinted and unimprinted products.

BRIEF DESCRIPTION OF THE DRAWINGS

FIG. 1 is a schematic diagram of a conventional dry laid papermaking operation, incorporating the imprinting means of the present invention.

FIG. 2 is a representation of a product web fabricated in accordance with the method of the present invention. The representation shown is not drawn to scale.

DESCRIPTION OF THE INVENTION

Figure 3:
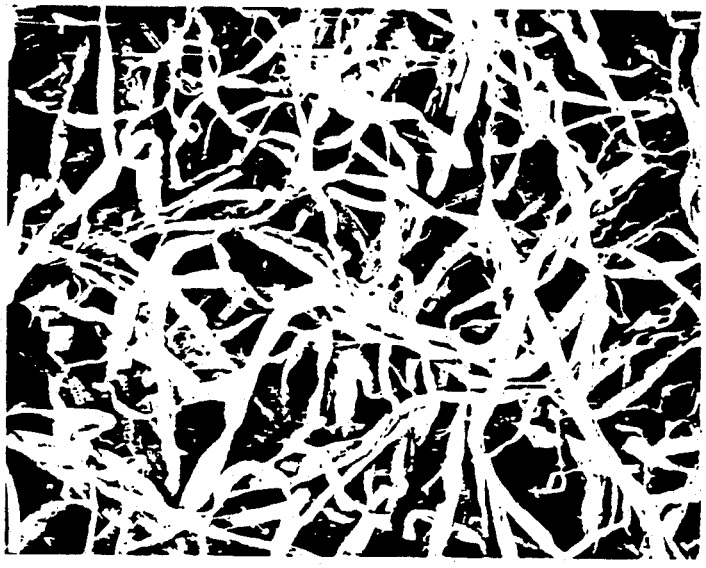
FIGS. 3 and 4 are photomicrographs of conventional unimprinted and 100% compacted webs respectively, each enlarged 74 times.

Referring to FIG. 1, a flow diagram of a process for making air laid webs, pulp sheets, laps, or bales 10 are defiberized in defiberizer 11, here a hammermill, and transported pneumatically through line 12 to distributor 14 by blower 13. Distributor arrangements are well known in the art.

The individual fibers are dispersed onto an endless fourdrinier wire 15, which circles continuously about guide rolls 16. Vacuum means 17 draws and retains the loose fibers 18 onto the wire 15 to form a loose web 19 which has little integrity. The loose web 19 is typically pressed by consolidation rolls 21, which compaction increases web strength to a limited extent, and permits transfer of the pressed web 22 to a carrier wire 23. Wire 23 has larger perforations than wire 15 and is made typically from a synthetic plastic material. The use of a separate wire 23, then, is less likely to cause plugging with bonding material 26 from spray dispensing means 27, and will improve clean up. As shown in FIG. 1, the once bonded web 29, partially dried in dryer 28, is transferred from carrier wire 23 to a second carrier wire 31 where a second spray means 33 dispenses additional bonding material 32 onto the second surface of the web. While two bonding applications are shown, one application will suffice where the web is porous and has a low basis weight, e.g., less than about 20 lbs. per 3000 sq. ft. ream. Additional information relating to a preferred process for bonding air laid webs is disclosed in commonly assigned U.S. patent application Ser. No. 108,022 entitled "Methods of Applying Bonding Materials Onto Fibrous Webs", filed Dec. 28, 1979 by Pauls et al. After each bonding application, the web is at least partially cured in dryers 28, 35. If complete drying is not achieved in dryer 35, a curing oven 40 is provided.

As shown in FIG. 1, the bonded, cured web 39, and before take up on parent roll 41, is then imprinted at an imprinting station, here a pair of cylindrical rolls 42, although this location is not critical. Alternatively, for example, station 42 can be situated between consolidation rolls 21 and bonding station 27, or between dryer 28 and bonding station 33. Indeed, the imprinting station may be located anywhere following the consolidation rolls 21. It should be noted that when the web is imprinted before the curing step, the compressive force applied by the imprinting means need not be as high as post curing imprinting because the pattern is less likely to "spring back". In another alternate embodiment, station 42 may be included as a step in the converting operation (not shown), either from parent rolls or individual product rolls. Preferably, it is less expensive to imprint webs before take-up on parent rolls rather than on individual product rolls during conversion because less capital investment is required. However, treatment of individual product rolls provides some additional flexibility in making products with several designs, which may be dictated by marketing considerations. If both sides of the web are to be imprinted, a second pair of cylindrical rolls is preferred. When platen means are used, however, only one pair of plates is necessary, each plate being provided with an etched surface.

Air laid products made in accordance with the process of FIG. 1, including webs imprinted (or embossed as hereinbefore defined) to achieve aesthetic improvement wherein the compacted surface area of the webs represents less than about 40% of the total surface area, are notably poor in absorption properties. This failing of prior art products is attributed to the inherently large pore volume between fibers in air laid webs. As discussed above, wet laid webs begin to bond as soon as they are laid. The high moisture content of the wet laid web, which decreases from about 99% by weight water beneath the head box to between about 65 to 85% just prior to consolidation, facilitates densification of the web. The water "lubricates" the web and "plasticizes" the fibers so that the individual fibers can come into close physical relationship with one another. Air laid webs do not have water to lubricate the fibers, resulting in less dense webs with greater bulk and larger interstitial void volumes. While bulk is highly advantageous, the consequences of excessively large void volume are not. Compaction by the vacuum means 17 and the consolidation rolls 21 is not intended to highly densify the webs. Although it would be possible to increase the pressure of the consolidation rolls to highly compact the webs, the beneficial bulk provided by the air laid process would be lost. Furthermore, densification of the web by the consolidation rolls 21 would compromise the ability to disperse bonding agent 26, 32 through the web.

The invention disclosed herein can be used with air laid webs of between about 8 and about 60 lbs. per ream (3000 sq. ft.) basis weight which have been consolidated by rolls 21 with pressures of between 50 and 300 lbs./lineal inch, and then bonded with a latex emulsion bonding agent, the bonding agent typically representing between about 10 to 30%, preferably between 15 and 25%, of the web basis weight. Typically, such webs have a bulk of between 0.7 to about 1.2 mils/lb./ream and a wet MD tensile strength of at least 200 gms. per 3 inch strip. Dry CD tensile is between 500 and 1500 gms. per 3 inch strip. Applicants test these webs for absorbency rate using a mirror wipe test. In this test, a given amount of distilled water, 1.4 ml., is placed on a flat 24"×36" mirror. A sheet of given size, 11 inches square, is used to remove the water under hand applied pressure, the time therefor being measured with a stop watch. The time required, mirror wipe time (MWT), is a measure of the rate of absorbency of the product: Although this test appears, at first inspection, to be more subjective than mechanical test methods known in the art, applicants, through extensive usage, have found that the test achieves nearly the same degree of accuracy. More importantly, applicants have found that the test is more indicative of consumer utilization than the mechanical test procedures. Furthermore, it should be understood that the test is being used herein to determine gross differences in absorbency rate so that the standard deviations of individual measurements are neglible by comparison.

Fully compressed webs were prepared by compaction between two flat plates under various compression loads, and tested for absorbency as tabulated below. For comparison purposes, the results for wet laid and dry laid uncompacted webs are included.

TABLE I

| Sample | Caliper (Mils) | Compression (lbs./in.$^2$) | Web Density (g./cc.) | MWT (Sec.) | % MWT Improvement |
|---|---|---|---|---|---|
| Wet Laid | 24.2* | 0 | — | 11.6 | — |
| Air Laid | 44.6* | 0 | 0.0812* | 32.0 | — |
| " | 9.04 | 16 | 0.367 | 11.5 | 64.1 |
| " | 7.26 | 83 | 0.459 | 12.0 | 62.5 |
| " | 6.14 | 165 | 0.542 | 14.6 | 54.4 |
| " | 5.06 | 320 | 0.660 | 13.5 | 57.8 |
| " | 4.19 | 826 | 0.797 | 13.5 | 57.8 |

*Uncompacted web.

Caliper was measured with a Testing Machines, Inc. (Amityville, N.Y.) Model 551M micrometer having a two inch anvil.

Figure 4:
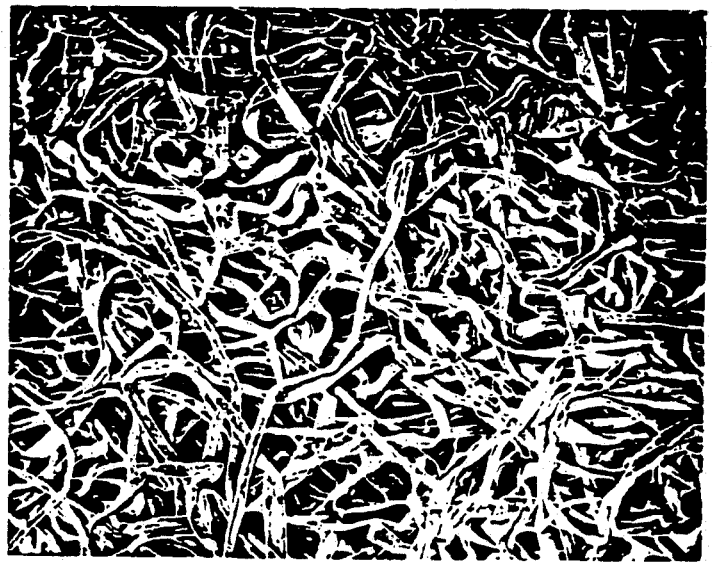

FIGS. 3 and 4 are photomicrographs of a conventional uncompacted air laid web and a compacted air laid web, respectively, each enlarged 74 times. As readily seen in the photographs, the densified web of FIG. 4 has much smaller interstitial voids between fibers as compared to the uncompacted web. Hence, capillary tension and wiping absorbency is increased in the web of FIG. 4 web as demonstrated by reductions in mirror wipe time. Note, however, that a significant loss in caliper occurs as a consequence of the compaction. This loss is more than about 80% in each instance.

In FIG. 2, a web 50 representative of the invention was prepared using a pair of etched plates each having raised areas representing 69% of the plate. That is, about 69% of each surface of the web was compacted. The web so treated had a grid pattern illustrated in FIG. 2. As shown therein, the compacted areas 51 were about 5/16 inch square (dimension x) and the non-compacted surfaces 52, e.g., the essentially uncompacted zones which appear as intersecting ribs or bridge regions, were about 1/16" wide (dimension y). The depth of the compacted areas is dependent upon the pressure applied by the plates. The uncompacted web (Table I) had a basis weight of 43 lbs./ream, and a caliper of 44.6 mils. Ideally, the imprinting of the web does not reduce the caliper of the non-compacted portions of the web, that is, dimension $C_1$, remains about 44 mils. However, some reduction occurs, typically less than about 10%, but possibly approaching 20 to 30%. A compression load of about seven tons was applied between the plates for about 20 seconds.

The caliper $C_1$ of the imprinted web was measured as 31 mils with the Model 551M Micrometer, as compared to 44.6 mils for the uncompacted web and as compared to less than 9.04 mils for the compacted webs. The loss in caliper is about 30% versus about at least 80% for the totally compacted webs. Conversely relative to the wet laid web, the caliper of the imprinted web is about 30% greater. Mirror wipe time for the imprinted web was measured at 17 seconds, which is an improvement of 46.9% over the conventional dry laid web.

While the actual pattern is not critical, it is essential that at least 40%, preferably more than 50%, of the area of one web surface be compacted. If both surfaces of web are compacted, each should be compacted to at least 40%, each preferably more than 50%. In the preferred embodiment, the plates or cylinders are heated to between 140° and 180° C., with water sprayed on the towel before pressing. The spray of water is not critical to the process, but it does aid in retention of the compaction.

Although the grid pattern of FIG. 2 is not critical to the concept of improved web absorbency rate by high compaction imprinting, the grid pattern does affect the end product beneficially in that the grid pattern prevents nesting of the compacted zones within one another when the web is taken up on a product roll. Thus, the roll of the invention web has essentially the same diameter as conventional products, which is preferred.

Figure 6:
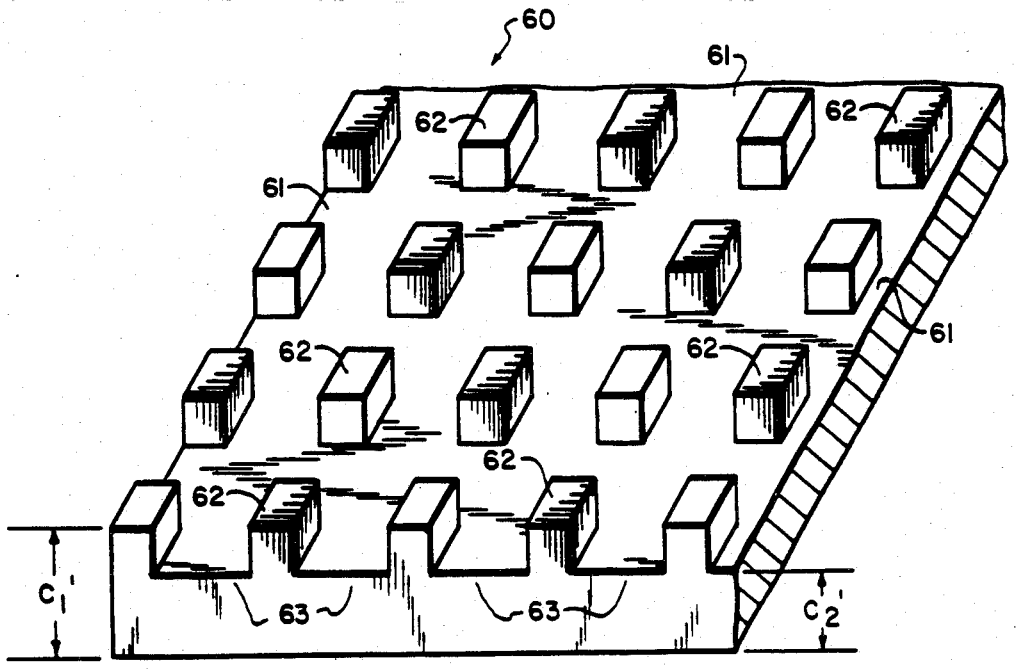
FIG. 6 is a representation of an alternate embodiment of the product web fabricated in accordance with the method of the present invention.

FIG. 6 illustrates an alternate embodiment of the web of the present invention. Although only one surface has received an imprinted pattern, both surfaces may be imprinted if desired. In this embodiment web 60 has compacted area 61 and a plurality of non-compacted areas 62. In contradistinction to the contiguous non-compacted bridge regions 52 of the web of FIG. 2, the web of FIG. 6 has contiguous compacted channel regions 61, which regions likewise represent at least 40% of the surface of the web so imprinted. As before, densified zones, here indicated by numeral 63, exist beneath the compacted area 61. These contiguous channel regions are desirable because they provide pathways for lateral wicking.

Figure 5:
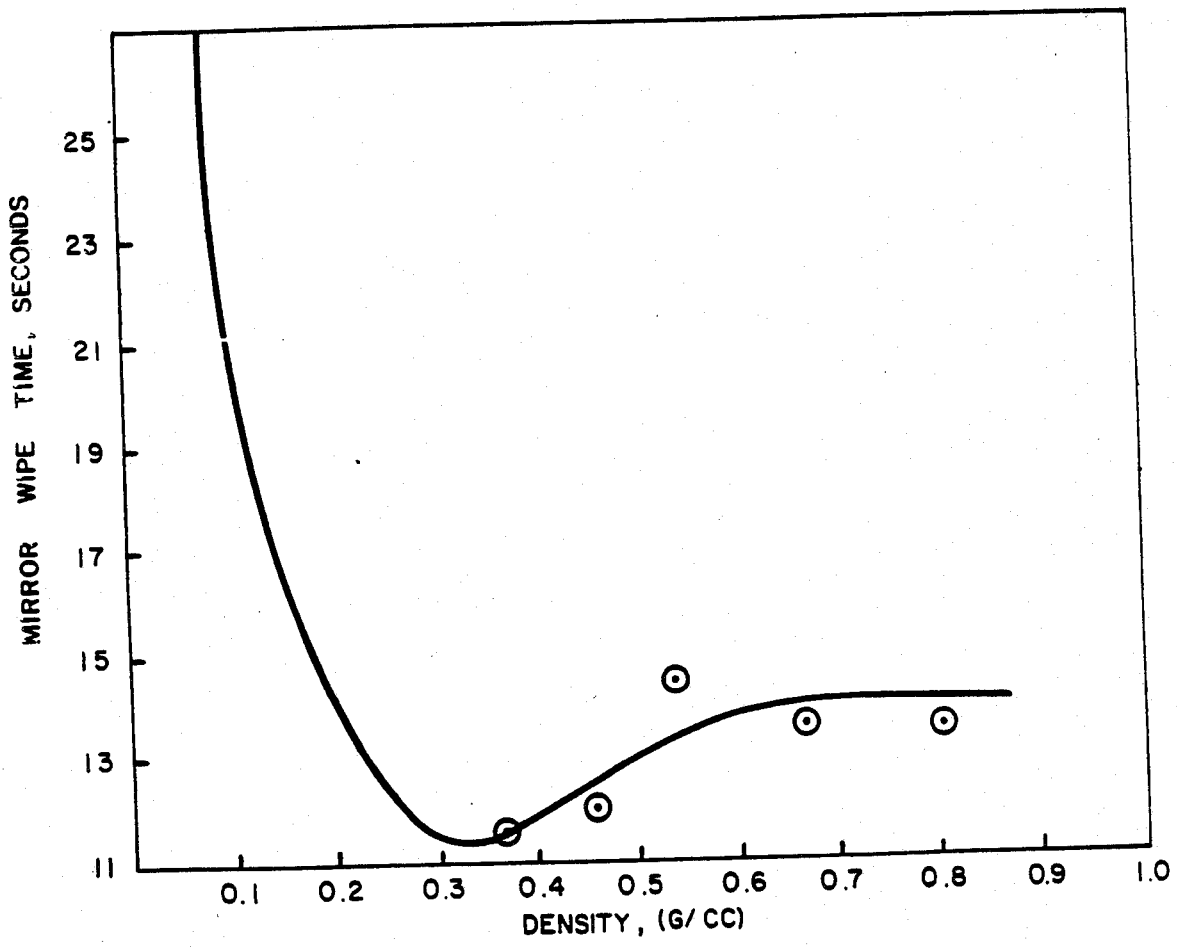
FIG. 5 is a graph of absorbency rate as measured by mirror wipe time versus web density for totally compacted webs.

The data of Table I is reproduced graphically in FIG. 5. This graph, a plot of compacted web density versus Mirror Wipe Time, shows that the improvement in MWT is rapid until a density of about 0.35 g./cc. is achieved, which value corresponds to a compression force of about 15 lbs./in.$^2$. Thereafter, MWT increases slightly, an asymptote being reached at about 0.80 g./cc. It is believed that analogous relationships between MWT and web density are applicable to the product of this invention. The reduction in absorbency at the higher density values in FIG. 5 apparently occurs because the interstitial voids are too small to permit large amounts of water to be absorbed. For this reason, the preferred densities of the densified web region are between about 0.20 to about 0.50 g./cc., which would correspond roughly to MWT's below 14 and 13 seconds, respectively, for the webs of this invention. It should be noted that the optimal density of 0.35 g./cc. provides essentially equal absorbency as compared to conventional wet laid webs, that is, an MWT of about 11.5 seconds.

The above disclosure is exemplary of the invention, and is not intended to be limiting except as respects the claims which are appended below.

We claim:

1. A dry laid fibrous web product of high bulk and enhanced absorbency rate comprising:

(a) a dry laid web of randomly distributed wood pulp fibers;

(b) an adhesive material substantially permeating said web, adjacent fibers being bonded to one another thereby, and (c) an imprinted pattern on at least one surface of said web, the pattern subdividing said surface into compacted regions and non-compacted regions in alternating relationship to one another, the area of the compacted regions being between about 50% and about 80% of each imprinted surface, the compacted regions having a density in the range of about 0.2 g/cc to about 0.5 g/cc;

whereby the portions of the web product underlying the compacted regions are compressed and densified reducing thereby the interstitial voids between adjacent fibers within said densified portions so that wiping absorbency is enhanced by increasing capillary tension and promoting wicking.

2. The product of claim 1 wherein the compacted regions represent between 50 and 70% of each imprinted surface.

3. The product of claimm 1 wherein the pattern is in the form of a grid comprising a plurality of discontinuous compacted region and contiguous non-compacted bridge regions.

4. The product of claim 3 wherein each compacted region has an area between about 0.05 to about 0.562 sq. in. and the bridge regions have a width between about 0.05 to 0.10 inch.

5. The products of claim 3 wherein absorbency rate as measured by mirror wipe time (MWT) is reduced by at least 25% as compared to corresponding unimprinted web products.

6. The product of claim 3 wherein the pattern is in the form of a grid comprising a plurality of discontinuous non-compacted regions and contiguous compacted channel regions.

7. The product of claim 6 wherein the non-compacted regions each has an area of between about 0.08 to about 0.25 square inch and the channel regions have a width of between about 0.15 to 0.36 inch.

8. The products of claim 1 wherein the absorbency rate as measured by mirror wipe time (MWT) is reduced by at least 40% as compared to corresponding unimprinted web products.

9. The products of claim 1 wherein the absorbency rate as measured by mirror wipe time (MWT) is less than about 15 seconds.

10. The products of claim 1, wherein each surface of the web is imprinted.

11. A dry laid fibrous web product of high bulk and an enhanced absorbency rate prepared by the process comprising the steps of:

(a) randomly distributing dry fibers onto a moving forminous support means to provide a dry loose web;

(b) consolidating the dry loose web;

(c) bonding the consolidated web with an adhesive material, the adhesive material substantially permeating the consolidated web;

(d) curing the adhesive material prior to take-up of the cured web on a parent roll; and (e) enhancing the rate of absorbency by the step of imprinting by application of pressure on at least one surface of the web, each imprinted web surface having a pattern characterized by a compacted area of from 50% to 80% of the total imprinted surface area, the imprinting being performed at any step in the method subsequent to the consolidation of the dry loose web, wherein the imprinting is performed under a pressure sufficient to compact and densify the web to a density of about 0.2 g/cc to about 0.5/cc.

* * * * *